United States Patent [19]

Abe et al.

[11] Patent Number: 4,540,272

[45] Date of Patent: Sep. 10, 1985

[54] MULTICOLOR PRINTING DEVICE

[75] Inventors: Fumitaka Abe, Kawasaki; Masatoshi Kimura, Yokohama; Toshihiko Watanabe, Atsugi; Hiroshi Yamada, Tokyo, all of Japan

[73] Assignee: Fujitsu Limited, Kawasaki, Japan

[21] Appl. No.: 477,950

[22] Filed: Mar. 23, 1983

[30] Foreign Application Priority Data

Mar. 25, 1982 [JP] Japan ..... 57-46390

[51] Int. Cl.[3] ..... G03G 15/01

[52] U.S. Cl. ..... 355/4; 355/3 DD; 430/45; 430/46

[58] Field of Search ..... 355/4, 3 DD; 430/44, 430/45, 46

[56] References Cited

U.S. PATENT DOCUMENTS 4,106,870 8/1978 Kondo et al. ..... 355/4

OTHER PUBLICATIONS

Patent Abstracts of Japan, vol. 4, No. 153, Oct. 25, 1980, p. 128P33 and JP-A-55-101955.

Patent Abstracts of Japan, vol. 3, No. 17, Feb. 14, 1979, p. 90E90 and JP-A-53-144737.

Patent Abstracts of Japan, vol. 5, No. 154, Sep. 29, 1981 and JP-A-56-87060.

Patent Abstracts of Japan, vol. 5, No. 154, Sep. 29, 1981 and JP-A-56-87058.

DE-A-3 140 081 (Hitachi) FIG. 1.

*Primary Examiner*—A. T. Grimley

*Assistant Examiner*—David S. Warren

*Attorney, Agent, or Firm*—Staas & Halsey

[57] ABSTRACT

A multicolor printing device comprising a latent image formation device, which forms an electrostatic latent image selectively corresponding to a plurality of colors on a latent image formation medium, and a plurality of developing devices which develop respectively the colors of the electrostatic latent image, wherein a developable regions are selectively defined in the latent image with regard to the colors of the plurality of developing devices.

7 Claims, 26 Drawing Figures

+800V
AFTER UNIFORM CHARGING

+800V
+50V
C
Y
M
C
Y
M
AFTER FORMING THE FIRST LATENT IMAGE

+800V
+500V
+50V
AFTER PASSING THROUGH CYAN DEVELOPING MACHINE

+800V
+500V
+50V
AFTER PASSING THROUGH YELLOW DEVELOPING MACHINE

+800V
+500V
+50V
C
Y
M
C
AFTER PASSING THROUGH MAGENTA DEVELOPING MACHINE

+800V
+500V
+50V
B
B
C
Y
M
C
AFTER FORMING THE SECOND LATENT IMAGE

+800V
+500V
+300V
+50V
C
Y
M
C
B
B
B
AFTER PASSING THROUGH BLACK DEVELOPING MACHINE

PRINTING DATA CONTROL TIMING CHART

MULTICOLOR PRINTING DEVICE

BACKGROUND OF THE INVENTION

The present invention relates to a multicolor printing device, more particularly to an electrostatic printer, laser printer, or other multicolor printing device in electrophotography.

As is well known, almost all colors and shades can be realized by combining the three primary colors i.e., red, green and blue or the complementary colors thereof, i.e., cyan, magenta, and yellow. Even the electrophotography multicolor printing process, comprising the steps of charging, latent image formation, development, transferring and cleaning, employs developers using the above-mentioned three primary colors or complementary colors.

One well-known conventional electrophotography multicolor printing process comprises repeated steps of latent image formation and development. Another comprises changing the latent image electric potential and development by changing the colors in accordance with the electric potential.

FIG. 1 is a schematic view of a conventional multicolor printing device employing the principle of repeated latent image formation and development. In FIG. 1, a drum 1 is formed by a conductive supporting body 1*a* and a photoconductive film 1*b*. The surface of the drum 1 is uniformly charged by a corona charger 2. A latent image with a developing color corresponding to cyan is formed on the photoconductive film 1*b* by a laser light source 3. The latent image formation portion is then developed by a cyan developer 4*a*, i.e., a cyan developing toner, by means of a developing machine 4. Next, a latent image with a developing color corresponding to yellow is formed on the photoconductive film 1*b* by a laser light source 5, and the latent image formation portion is developed by a yellow developer 6*a* by means of a developing machine 6. Similarly, a latent image with a developing color corresponding to magenta is formed on the photoconductive film 1*b* by a laser light source 7, and the latent image formation portion is developed by a magenta developer 8*a* by means of a developing machine 8.

After the cyan latent image, yellow latent image, and magenta latent image are developed, toner images are formed on the photoconductive film 1*b* are transferred to a paper 10 using a corona discharger 9. The residual toners on the photoconductive film 1*b* are then removed by a fur brush 11 to clean the photoconductive film 1*b*. The drum 1 is then rotated and the above-mentioned processes, i.e., charging, latent image formation, development, etc. are repeated for a continuous printing process.

However, this conventional device has the problem of mixing between the colors. FIGS. 2A to 2C are schematic views explaining this phenomenon.

As shown in FIG. 2A, after charging, cyan developing toners 12*a* are supplied to a latent image formation portion 12 corresponding to the cyan developer. Then, as shown in FIG. 2B, yellow developing toners 13*a* are supplied to a latent image formation portion 13 in accordance with the predetermined electric potential. However, as shown in FIG. 2C, when the yellow developing toners 13*a* are supplied to the latent image formation portion 13, part of the cyan developing toners 12*a* supplied to the cyan latent image formation portion 12 is sometimes replaced by excessive yellow developing toners 13*b*, because of electrical or mechanical forces.

Consequently, proper colors are not developed in the predetermined positions. Thus, the above-mentioned problem of color mixing occurs.

FIG. 3 is a schematic view of another conventional device employing the principle of changing the latent image electric potential and development by changing the colors in accordance with the electric potential. In FIG. 3, parts corresponding to those of FIG. 1 are represented by the same reference numerals.

In FIG. 3, a surface of a drum 1, comprised of a conductive supporting body 1*a* and a photoconductive film 1*b*, is uniformly charged by a corona charger 2. Then, half of the electric potential of portions other than latent image formation is removed by laser light source 3. Latent images of another color are then exposed by another laser light source 3 to substantially reduce the above electric potential to zero. The resultant distribution of the electric potential is illustrated in FIGS. 4A–4C. The high electric potential position is the first latent image and the substantially zero voltage portion is the second latent image. After the first and second latent images are formed, red toners, for example, are adhered to the first latent image by a developing machine 4. Then black toners, for example, are adhered to the second latent image by a developing machine 6. In this way, a two-color printing process is carried out.

It is, however, difficult to apply a middle level electric potential (Vb) to form a latent image due to factors such as deterioration of the photoconductive film or due to the laser light source. This makes it difficult to realize printing of more than two colors.

SUMMARY OF THE INVENTION

It is an object of the present invention to provide a multicolor printing device having a simple structure, in which the problem of color mixing in printing color images does not occur.

According to the present invention, there is provided a multicolor printing device comprising a latent image formation means, which forms electrostatic latent image corresponding to a plurality of color on a latent image formation medium, and a plurality of developing means, which develop the colors of the electrostatic latent image. The device is characterized in that a means which defines a developable region with regard to the colors of the latent image is provided with the plurality of developing means.

It is preferable that the means which defines the colors of the developable region be provided between the latent image formation medium and the developing means.

Further, it is preferable that the means which defines the colors of the developable region be formed by a plate having openings at development positions of the plurality of developing means.

Other objects and advantages of the invention will become apparent from the following description of embodiments with reference to the accompanying drawings.

BRIEF EXPLANATION OF THE DRAWINGS

As described earlier.

DETAILED DESCRIPTION OF THE PREFERRED EMBODIMENTS

Figure 1:
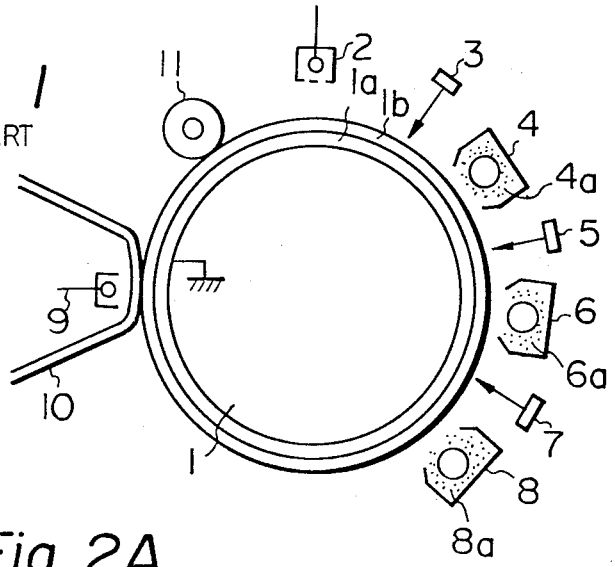
Fig. 1 PRIOR ART
FIG. 1 is a schematic view of a conventional multicolor printing device.
Figure 2A:
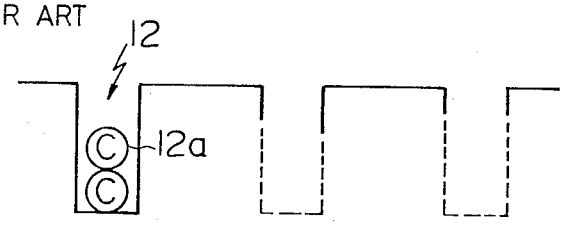
Fig. 2A PRIOR ART
FIGS. 2A to 2C are schematic views explaining the color mixing of the prior art.
Figure 2B:
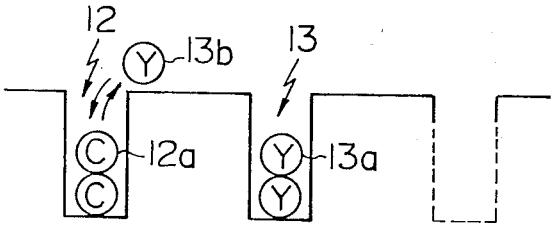
Fig. 2B PRIOR ART
Figure 2C:
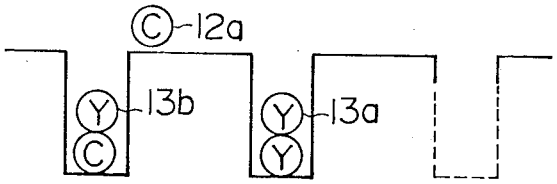
Fig. 2C PRIOR ART
Figure 3:
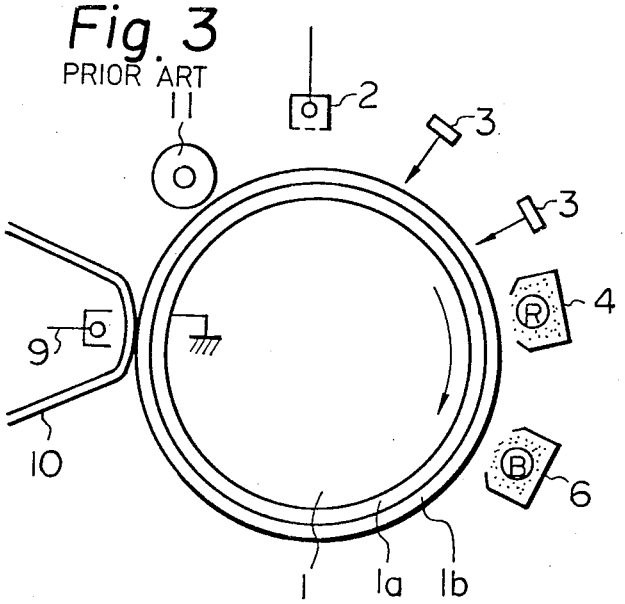
Fig. 3 PRIOR ART
FIG. 3 is a schematic view of another conventional device.
Figure 4A:
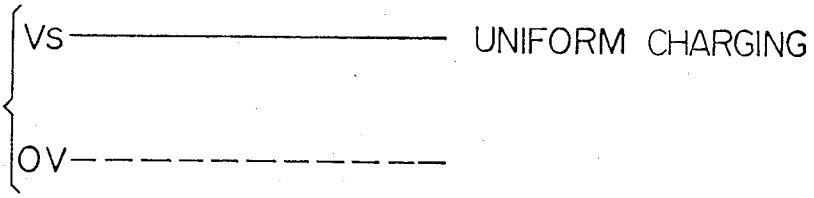
Fig.4A PRIOR ART
FIGS. 4A–4C are views of distribution of the respective electric potential.
Figure 4B:
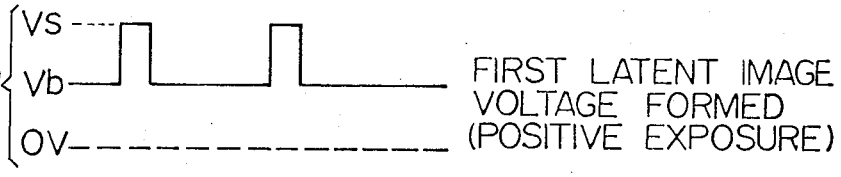
Fig.4B PRIOR ART
Figure 4C:
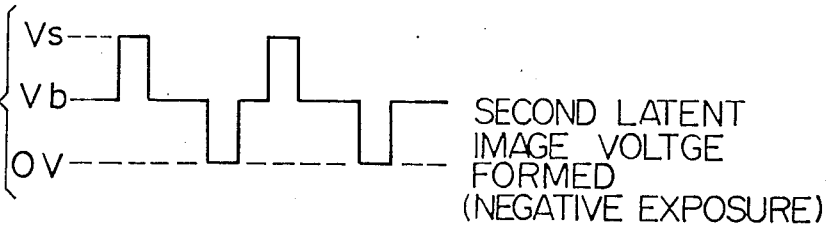
Fig.4C PRIOR ART
Figure 5:
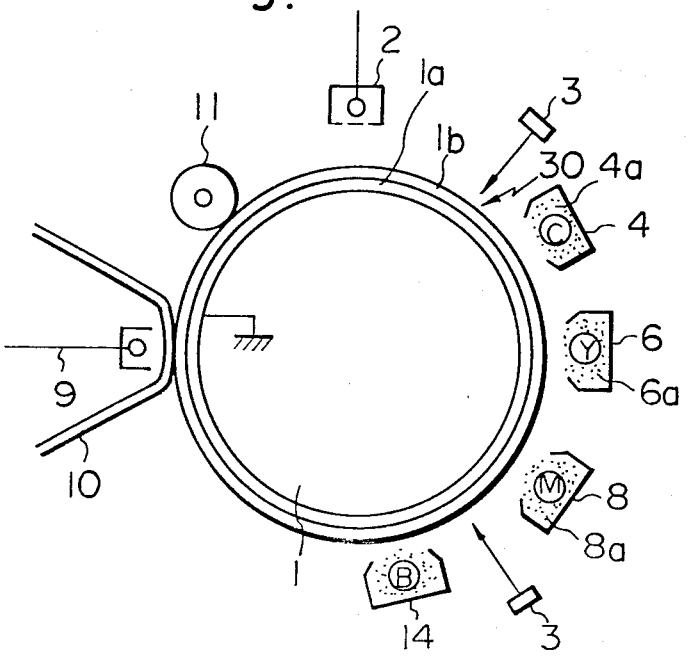
FIG. 5 is a schematic view of an embodiment according to the present invention.

As shown in FIG. 5, around a drum 1 are provided a corona charger 2; laser light sources 3; developing machines 4, 6, 8, and 14, each with developers of cyan, yellow, magenta, and black; discharger 9; paper 10; and fur brush 11. The drum 1 comprises a conductive supporting body 1*a* and a photoconductive film 1*b*. The surface of the photoconductive film 1*b* is uniformly charged at a level of +800 V by the corona charger 2. Then electrostatic images are formed on the photoconductive film 1*b* by the laser light source 3.

Figure 6:
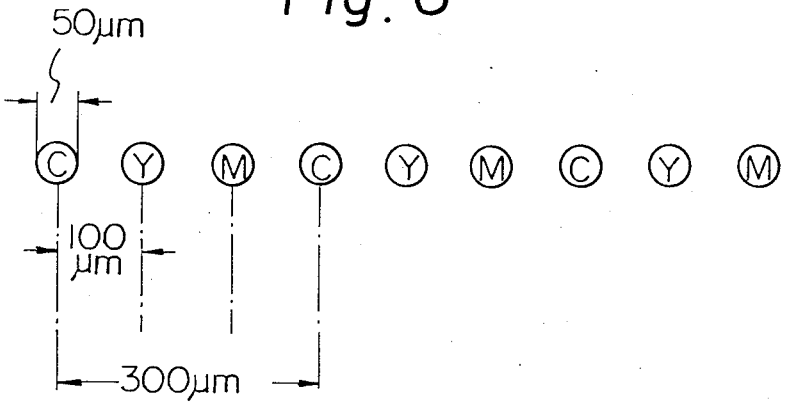
FIG. 6 is a schematic view explaining a process of forming latent images.

Latent images corresponding to the development colors of for example, cyan 4*a* ( Ⓒ ), yellow 6*a* ( Ⓨ ), and magenta 8*a* ( Ⓜ ) are provided as shown in FIG. 6. The diameter of the dots of latent images which form various colors is 50 μm (micron), and the pitch of the latent images is 100 μm. Latent images corresponding to the three colors of cyan, yellow, and magenta are simultaneously formed at a latent image formation portion 30 by one scanning process of a laser beam.

Figure 7:
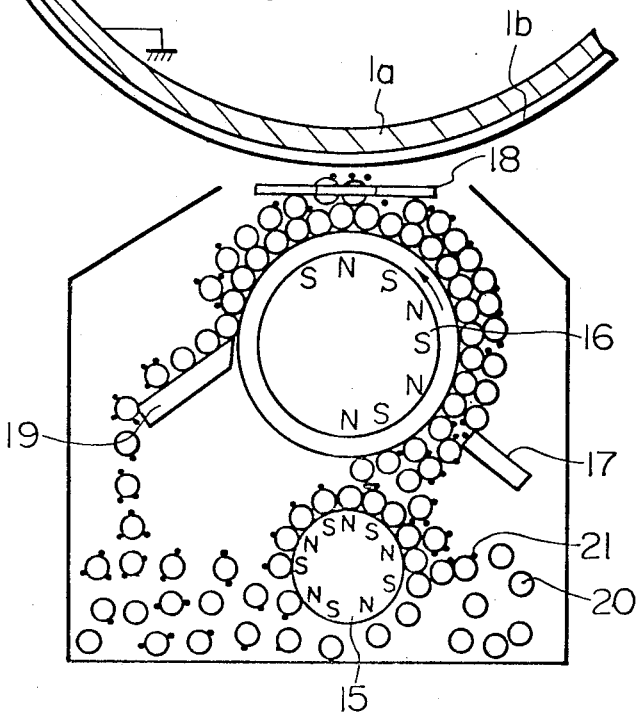
FIG. 7 is a schematic view of a cyan developing machine according to the present invention.

In FIG. 7, a cyan developing machine comprises a magnetic roller 15 for agitation, by which a binary developer, consisting of carriers 20 of iron filings having a diameter of, for example, 100 to 200 μm, and of toners 21, i.e., fine particles colored with cyan, is agitated and charged by friction; a magnetic roller 16 for development which develops electrostatic latent images; a blade 17 which aligns the developer; a slit plate 18 for supplying the developer only to a position wherein latent images for cyan are formed; and a blade 19 for removing residual developer.

Figure 8:
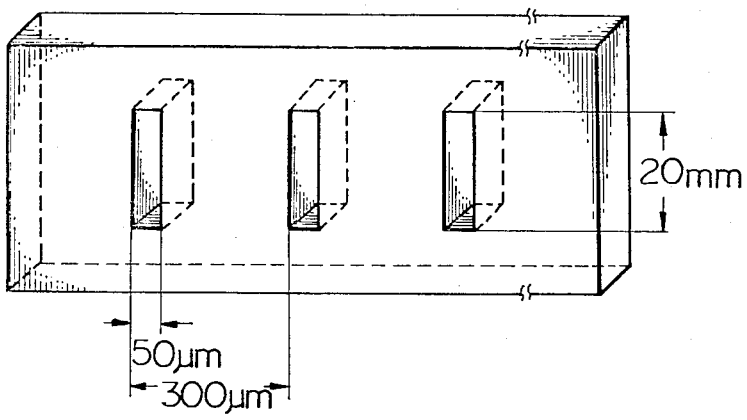
FIG. 8 is a schematic perspective view of an embodiment of a slit plate for cyan.
Figure 11:
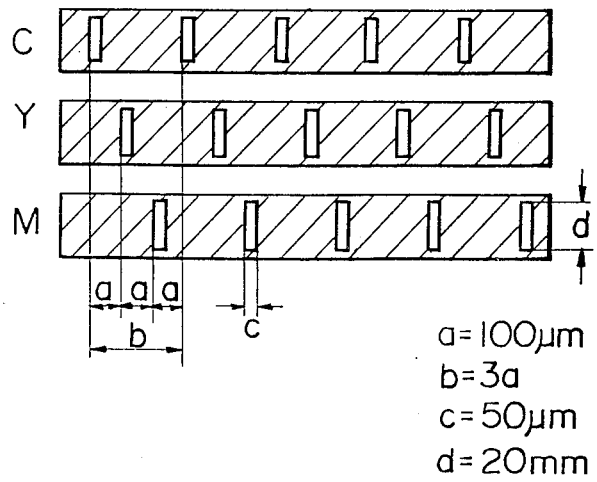
FIG. 11 is a schematic view of a slit plate for cyan, yellow and magenta.

FIG. 8 shows the slit plate 18 in more detail. The slit plate 18, made of copper, has slits with a length of 20 mm, a width of 50 μm, a pitch distance of 300 μm, and a thickness of 200 μm. The slit plate 18 is aligned with the predetermined position of the cyan latent image so that only the cyan latent image can be developed with the cyan developing toners. Slit plates in the yellow and magenta developing machine have similar slits (as shown in FIG. 11). Use of such slit plates enables development of latent images for cyan, yellow and magenta without mixing and, therefore, improved color images, since the slit widths corresponding to the different colors do not overlap.

Returning to FIG. 5, in order to obtain a clear black color, a latent image is formed on the photoconductive film 1*b* by the laser light source 3 with a resolution limit of 10/mm. Then, the black latent image is developed by using high resistivity toners. These multicolor toner images are then transferred from the surface of the photoconductive film 1*b* to a paper 10 by a corona discharge 9. The residual toners on the drum 1 can be removed with a fur brush 11 by a well known process. The above multicolor printing process is continuously repeated.

Figures 9A, 9B, 9C, 9D:
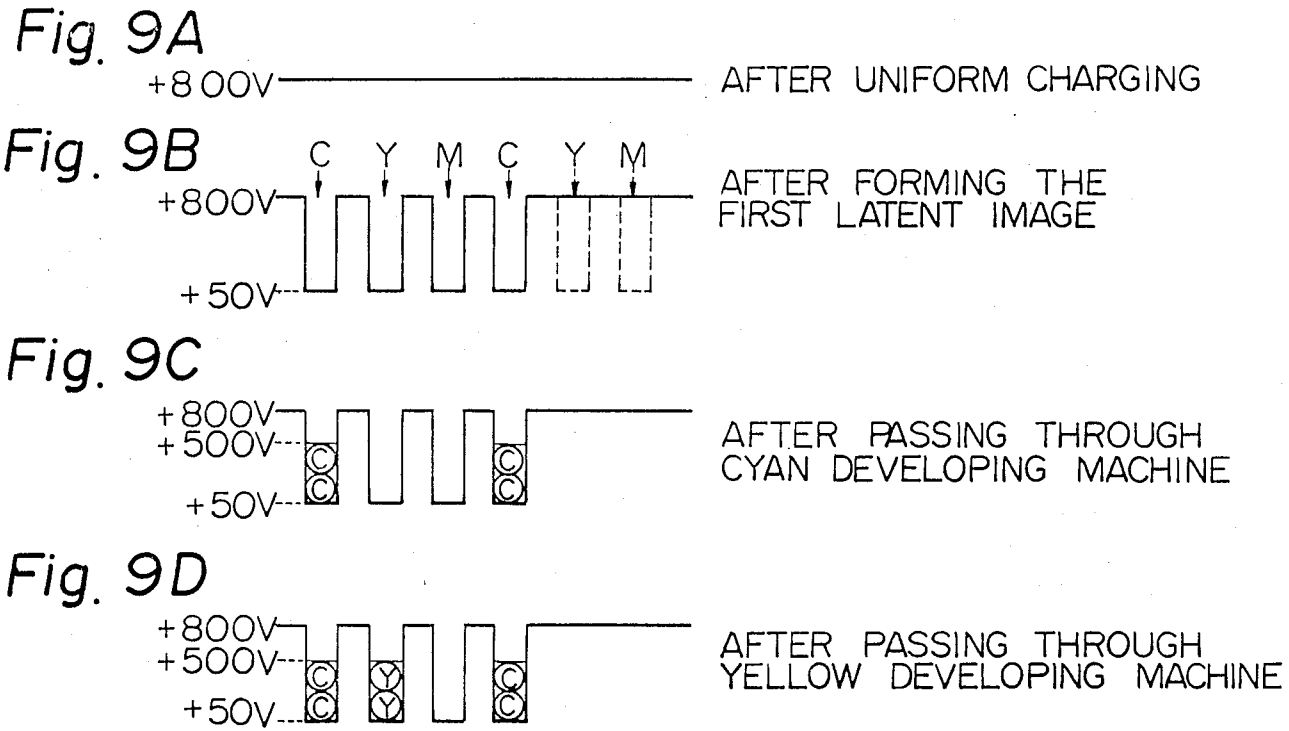
FIGS. 9A to 9G illustrate a change of electric potential in a printing process according to the present invention.

FIGS. 9A to 9G illustrate changes of electric potential, in the above printing process. As shown in FIG. 9A, the surface of the drum 1 is first uniformly charged to +800 V. Then, the first latent image formation portions are formed at the corresponding cyan, yellow, and magenta positions. A latent image electric potential of +50 V is obtained corresponding to the above three colors, as shown in FIG. 9B. Then, only the cyan latent image, whose position is limited at the time of forming the latent images, is developed by the cyan developing machine 4 so that the cyan developing toner is adhered to the limited portion. The surface electric potential of the toner layer amounts to about 500 V, as shown in FIG. 9C. Similarly, yellow developing toners ( Ⓨ ) are adhered next to the cyan developing toners ( Ⓒ ) by a yellow developing machine 6, as shown in FIG. 9D. Then magenta developing toners ( Ⓜ ) are adhered next to the yellow developing toners ( Ⓨ ) by a magenta developing machine 8. The surface electric potential of the toner layers which develop various colors amounts to about 500 V, just as in the case of cyan. In this case, the bias voltage, Vb, for the development is maintained to 600 V to lower the back concentration.

Figures 9E, 9F, 9G:
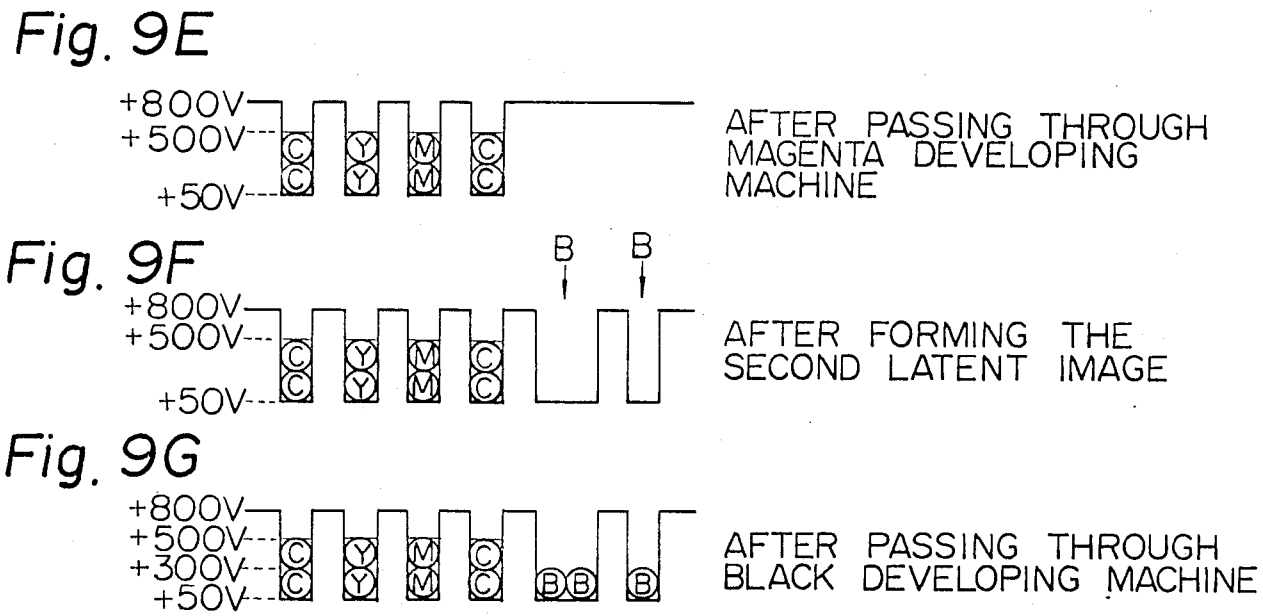
Figure 10:
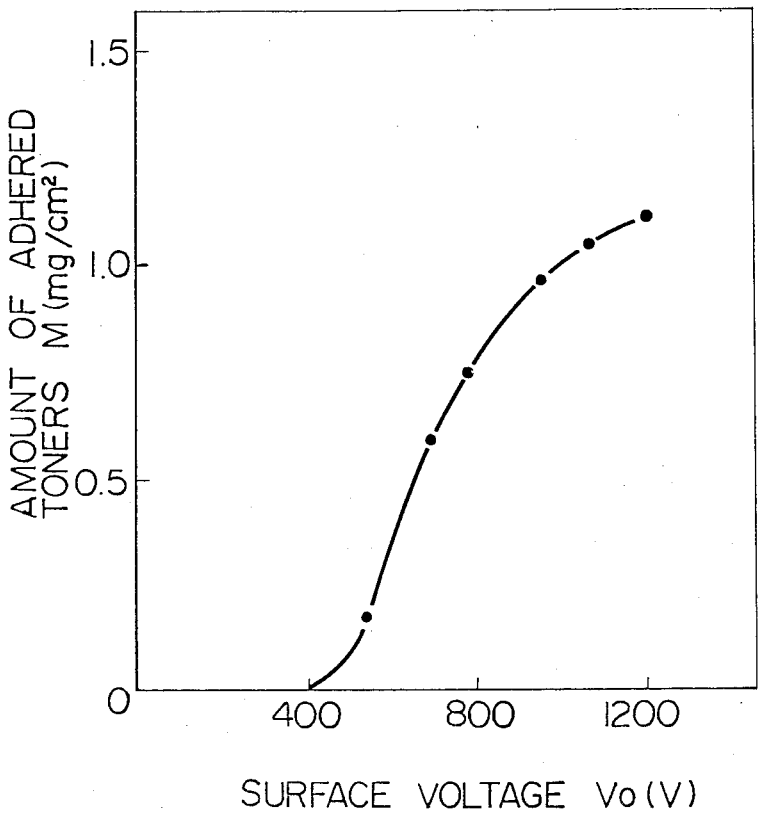
FIG. 10 shows the property of a magnetic toner having a mono-composition and high resistivity.

Then, the second latent image formation portion corresponding to black is formed, and the electric potential of the latent image becomes 50 V, as shown in FIG. 9F. In the second latent image formation, magnetic toners having a mono-composition and high resistivity are used. The developing property of such high resistivity, mono-composition magnetic toners is such that the developing process occurs when the surface voltage $V_0$ exceeds the threshold, 500 V, as shown in FIG. 10.

Thus, when the developing bias voltage of the magnetic brush developing machine is set to 800 V, black toners having a mono-composition are not adhered to the cyan, yellow, and magenta toners. Therefore, only black toner latent images are developed. As a result, the surface electric potential of the black toner becomes 300 V as shown in FIG. 9G.

Figure 12:
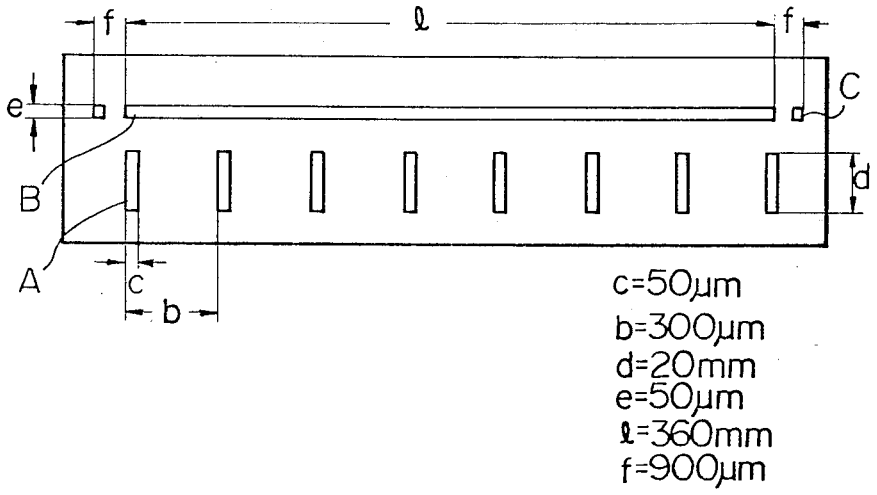
FIG. 12 and FIG. 13 are schematic views of embodiments of a slit plate for cyan.
Figure 13:
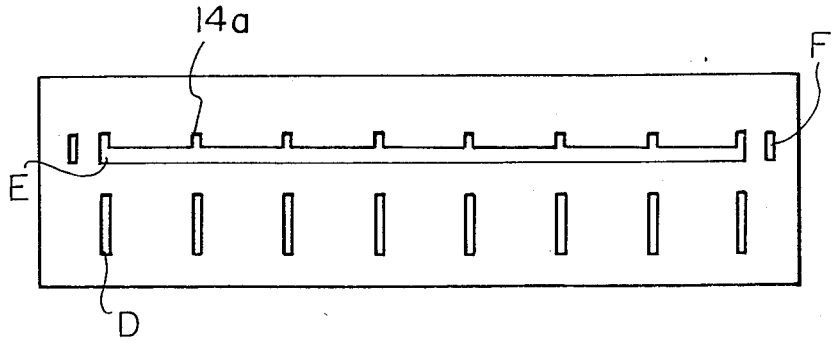

Embodiments of the slit plates are illustrated in FIGS. 12 and 13.

The slit plates shown in FIGS. 12 and 13 are advantageous in that they allow positions corresponding to a latent image and to an area to be developed to be inspected.

In FIG. 12, a slit A for development has a slit width c of 50 μm, a pitch distance b of 300 μm, and a slit length d of 20 mm. Slit B for latent image formation has a rectangular shape with a width e of 50 μm and is a length l of 360 mm and formed above the slits A. A position marking slit C is provided at both sides of the slit plate. In FIG. 13, there are slits D for development and a slit E for latent image formation, corresponding to slit A and slit B. A position marking slit F, however, is not the same as slit C. Portions 14*a* are provided at the upper portion of slit E and directly above each slit D.

Figure 14:
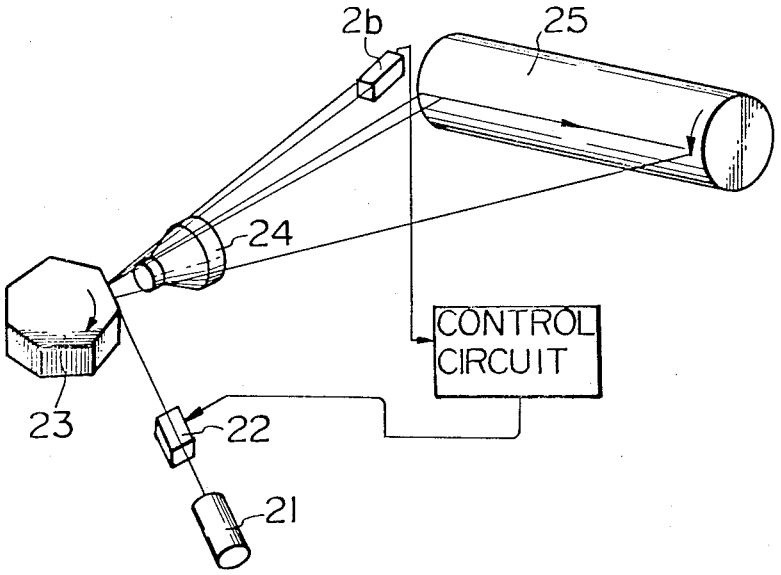
FIG. 14 is a schematic perspective view of an optical system for laser scanning and laser beam modulation transfer control.

The process for synchronizing the latent image formation and development will now be explained below with reference to FIGS. 12 to 16. In FIG. 14, before a color latent image is formed, a laser scanning exposure is carried out. The time from when the laser scanning starts to when the laser scanning ends is measured and is equally divided to provide periodic color signal clocks. The color signal clocks, such as for cyan, are provided with a predetermined period at respective times. Then, the time from when the laser scanning starts to when the laser scanning ends is measured and is equally divided to correspond to another color signal clock.

Use of the slit according to the present invention provides an accurate one-to-one correspondence between the latent image formation and development for a plurality of colors, thus preventing mixing of colors. Furthermore, a color signal clock which reflects changes of temperature and aging can be obtained.

In the slit plate shown in FIG. 13, the dot patterns are formed at the latent image portion by a photomodulator only when the slit plate corresponds to the character and image pattern. At this time, the reflected laser light which hits the position inspecting mark can be read. This is input to a phase lock loop circuit as data. Then, the timing corresponding to the slit width is set on the basis of the color signal basic clock.

The embodiment of the slit shown in FIG. 13 can obtain more precise correspondence of the latent image and development thereof than the embodiment shown in FIG. 12.

As shown in FIG. 14, a beam emitted from a laser light source 21 is light modulated by photomodulator 22 and is deflected by a rotatable polygonal mirror 23. The deflected beam is collected at a predetermined position of a drum 25. In order to determine the correct position on the drum 1, the scanning beam is synchronized with such timing to enter an optical detecting device 2*b* provided at the scanning start position.

Figure 15:
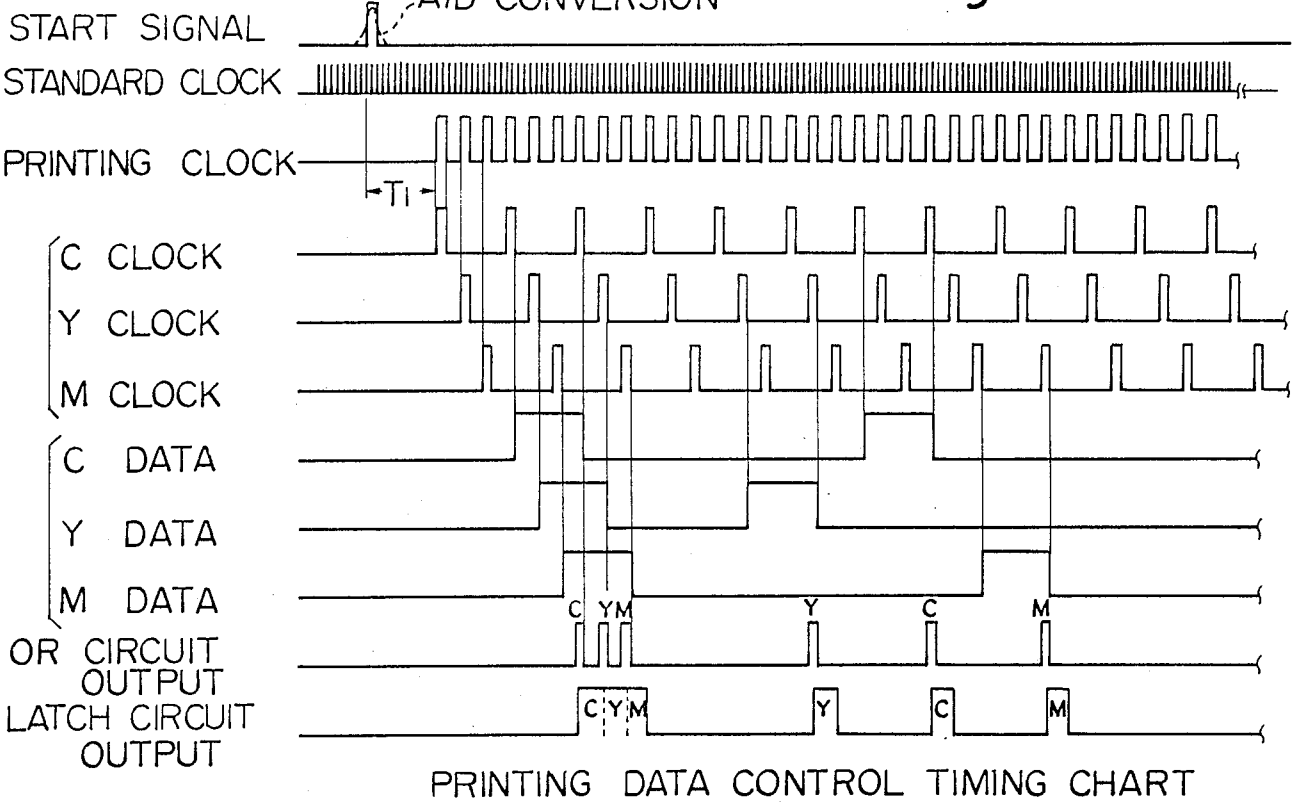
FIG. 15 is a printing data control timing chart.
Figure 16:
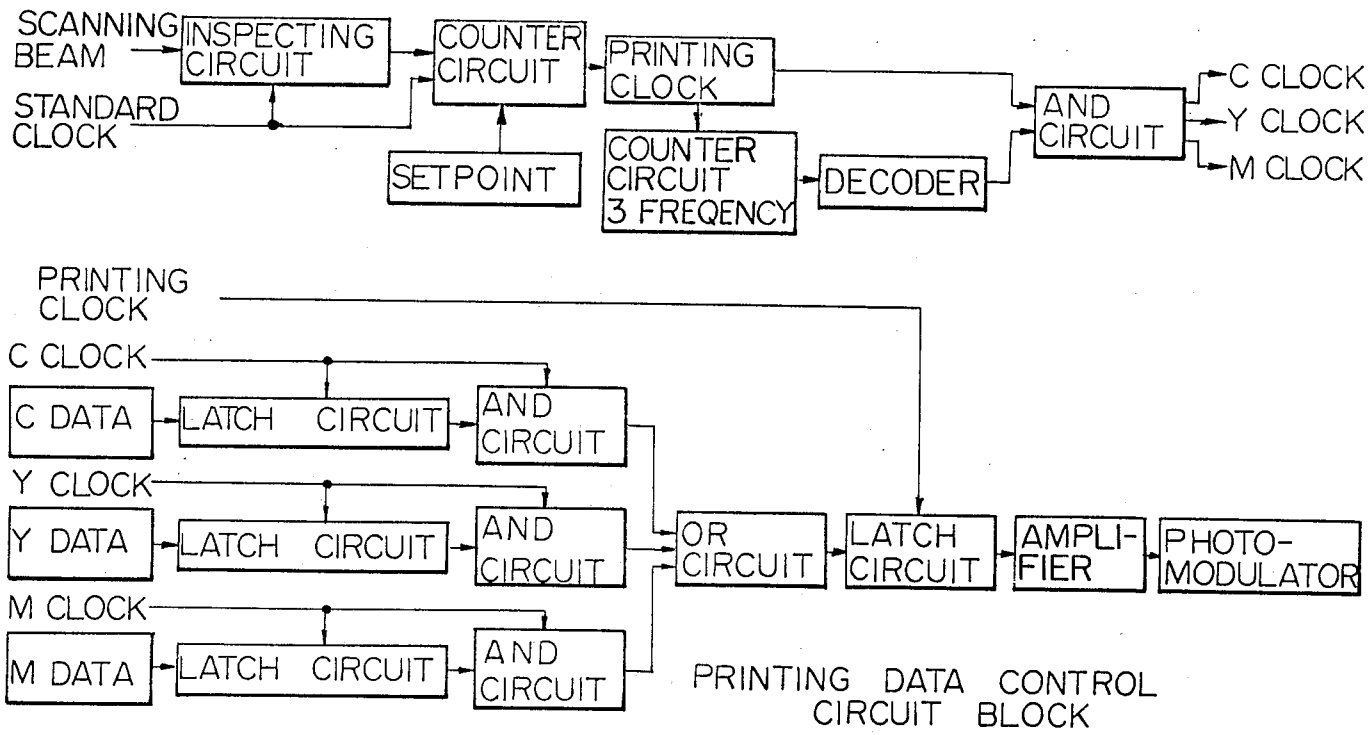
FIG. 16 is a view of a printing data control circuit block.

As shown in FIG. 15, the control system has a standard clock having the frequency of several times a printing dot clock. The beam entering the optical detecting device 2*b* is analog-to-digital converted, as a signal synchronized to the standard clock in a starting detecting circuit, to a starting signal. After the starting signal, a printing clock is provided by counting and dividing by n the standard clock. This printing clock corresponds to the printing position of, for example, cyan, yellow, and magenta in a multicolor printing process. By dividing the printing clock into three, a cyan (Y) clock, yellow (Y) clock, and magenta (M) clock are formed. To keep the clocks accurate, they are corrected by the printing clock according to the inputs to the AND circuit. By using such clocks, data concerning the colors is read to provide a series of data by an OR circuit. This data is latched by the printing clock and the optical modulator is operated by a NOW RETURN ZERO (NRZ) process.

We claim:

1. A multicolor printing device comprising a latent image formation means, which selectively forms an electrostatic latent image on a latent image formation medium, wherein said latent image includes respective portions corresponding to a plurality of colors to be developed, a plurality of developing means for respectively developing said corresponding colors after the formation of said latent image, and means for defining respective developable regions of each developing means in correspondence to said respective portions of said latent image for said corresponding colors to be developed, said means for defining being located between said latent image formation means and said developing means.

2. A multicolor printing device according to claim 1, said means for defining said developable regions comprising a respective plate having openings for determining said respective developable regions of said latent image at each of said plurality of developing means.

3. The device of claim 2, wherein the openings of said plates do not overlap.

4. The device of claim 2, comprising means for forming and developing a further latent image and further corresponding developing means.

5. The device of claim 2, said latent image formation means comprising a slit plate and a laser scanning means for scanning a laser beam along a slit in said slit plate for forming said latent image with said respective portions corresponding to said colors.

6. The device of claim 5, said slit in said slit plate having position inspection marks along one edge of said slit, with spacing between said position inspection marks corresponding to the spacing of said openings of said plates of said means for defining said developable region.

7. The device of claim 1, said means for defining including a respective component at each said developing means for determining the respective developable region.

* * * * *